US007899200B2

(12) United States Patent
Karamuk et al.

(10) Patent No.: US 7,899,200 B2
(45) Date of Patent: Mar. 1, 2011

(54) UNIVERSAL-FIT HEARING DEVICE

(75) Inventors: Erdal Karamuk, Meilen (CH); Sven von Dombrowski, Baden (CH)

(73) Assignee: Phonak AG, Stafa (CH)

( * ) Notice: Subject to any disclaimer, the term of this patent is extended or adjusted under 35 U.S.C. 154(b) by 1307 days.

(21) Appl. No.: 11/421,920

(22) Filed: Jun. 2, 2006

(65) Prior Publication Data

US 2007/0280496 A1 Dec. 6, 2007

(51) Int. Cl.
*H04R 25/00* (2006.01)

(52) U.S. Cl. ..... 381/328; 381/322; 381/380

(58) Field of Classification Search ..... 381/322–325, 381/327–328, 330–331, 380–381; 379/430
See application file for complete search history.

(56) References Cited

U.S. PATENT DOCUMENTS

| | | | | |
|---|---|---|---|---|
| 3,265,819 | A | 8/1966 | Hermann | |
| 4,881,616 | A | 11/1989 | Janssen et al. | |
| 5,048,090 | A | 9/1991 | Geers | |
| 5,142,587 | A | 8/1992 | Kobayashi | |
| 7,203,331 | B2 * | 4/2007 | Boesen | 381/380 |
| 7,421,086 | B2 * | 9/2008 | Bauman et al. | 381/328 |
| 7,590,255 | B2 * | 9/2009 | Nielsen | 381/328 |
| 2003/0174853 | A1 | 9/2003 | Howes et al. | |
| 2004/0096075 | A1 | 5/2004 | Kuhlmann | |
| 2007/0092094 | A1 * | 4/2007 | Gilbertson | 381/328 |
| 2007/0183615 | A1 * | 8/2007 | Wurfel | 381/330 |
| 2008/0205679 | A1 * | 8/2008 | Darbut et al. | 381/328 |

FOREIGN PATENT DOCUMENTS

| | | | |
|---|---|---|---|
| DE | 10227450 | A1 | 1/2004 |
| EP | 1448014 | A1 | 8/2004 |
| WO | 9407343 | A1 | 3/1994 |
| WO | 02052890 | A1 | 7/2002 |
| WO | 03096745 | A1 | 11/2003 |
| WO | 2004025990 | A1 | 3/2004 |
| WO | 2004036953 | A1 | 4/2004 |
| WO | 2006026988 | A1 | 3/2006 |

OTHER PUBLICATIONS

International Search Report, PCT/EP2006/062867, Dec. 14, 2006.

* cited by examiner

*Primary Examiner* — Suhan Ni
(74) *Attorney, Agent, or Firm* — Pearne & Gordon LLP

(57) ABSTRACT

An in-the-ear hearing instrument comprises a deformable holding element (3) outside the ear canal and a sealing element (7) comprising venting elements. The sealing element is an exchangeable resilient eartip, which by means of venting elements, such as holes, channels, openings, etc. defines the amount of acoustic leakage.

14 Claims, 3 Drawing Sheets

UNIVERSAL-FIT HEARING DEVICE

Figure 1:
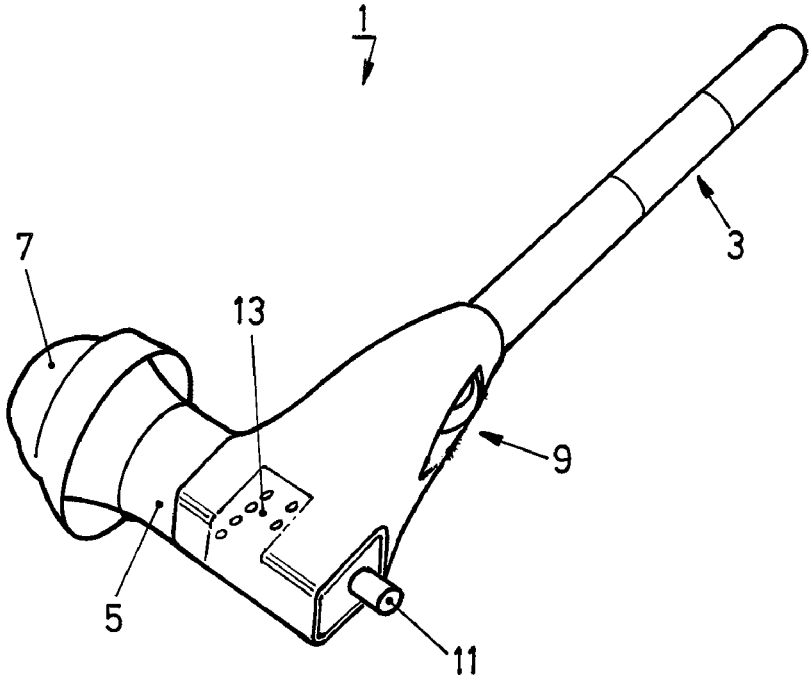

The present invention refers to a hearing aid according to the introduction of claim 1.

More particular, the present invention refers to a hearing device which has a universal shape for instant-fit use and is being worn as an in-the-ear device, which fits snugly into the ear of a large number of users.

Hearing aids which are intended to fit into the ear canal of a user are dominantly custom made, meaning that each device has a shape that fits to the anatomy of the individual's ear.

In the past years some manufacturers proposed one-size-fits-all hearing aids. The Songbird Device developed by Sarnoff Cooperation is a well known representative. But also Adesso by Sonic Innovation belongs at least partially to that class of hearing devices. Adesso is a small CIC (completely-in-the-canal hearing aid) with a universal hard housing, over which a sleeve can be applied. At the initial fitting session, the sleeve is soft and universal, making this device a universal hearing device.

But besides there are other types of universal fit ITE (in-the-ear), ITC (in-the-canal) and CIC hearing devices. The following overview focuses on devices with at least one microphone, one signal processing unit and one receiver and a power source, such as a battery.

Headsets, headphones are typical examples of universal fit hearing devices that are placed in the ear, which means in the concha or the ear canal of the wearer. Due to the weight and dimensions of such devices, the fixation is a critical issue. Often, the devices use a bow which goes from the device behind the ear.

Microsound Pilot by Microsound is a hearing aid which has a hard shell and a soft universal-fit tip. The tip is placed in the ear canal, the device is retained mainly by holding it between the opening of ear canal and the tragus.

Furthermore, several hearing aids are proposed in patent literature of which the following examples are mentioned:

Within the DE 10227450 a headset is disclosed with a microphone and a signal processing unit and a receiver. The headset is placed in the concha, such that the receiver holding unit covers the ear canal. The headset is fixed by a fixation bow which lies in the concha. This bow is adjusted to the shape of the concha by bending.

The U.S. Pat. No. 5,142,587 discloses an intra-concha type electroacoustic transducer with an auxiliary supporter which after insertion is urged against the concha wall such that the housing is securely lodged between the tragus, the antitragus and the concha wall.

The US 2003 0 174 853 discloses an ear mount for a personal audio-set. The mounting portion is resilient and biased to a neutral position and operatively secured to the actual audio-set. The mounting portion is sized to engage the antihelix of the wearer's ear.

The US 2004 0 096 075 discloses a device with acoustic effect and a housing for being located in the cavum conchae of a human ear. The housing has a face adapted to abutment on the tragus, a face adapted for abutment on the antitragus, a mouthpiece adapted for being inserted into the mouthing of the auditory tract. Additionally, the housing contains a resilient spring-element that is placed between the antihelix and the concha and configured for influencing the housing with a force oriented generally towards the tragus.

The U.S. Pat. No. 5,048,090 discloses a hearing aid comprising a transmitter (receiver) and a microphone housing part associated with the external ear, together with associated actuating units, which is characterized in that the microphone housing part is formed as a plastic hook or an at least partially elastically deformable unit adaptable individually to the curve of the concha.

The W002/052890 describes a device with acoustic effect and a housing for being located in the cavum conchae of a human ear. The housing has a face adapted for abutment on the tragus, a face adapted for abutment on the antitragus, a mouthpiece adapted for being inserted into the mouthing of the auditory tract and a resilient means adapted for abutment onto the cartilage arch between the antihelix and the concha, which influences the housing by a force oriented forwards towards the tragus.

The WO 2003 096745 describes a hearing device with one first part specially shaped and which is flexible to be placed in the concha of the wearer.

The WO 2004 036953 describes an in-the-ear hearing prosthesis comprising at least one loudspeaker arrangement and at least one microphone arrangement acoustically communicating with at least one sound input portion.

The EP 671 115 proposes a method for securing in position a hearing aid in or at least partially in a person's auditory canal, said hearing aid characterized in that the outer shell of the aid is not individually adapted to the person's auditory canal, and in that the hearing aid is secured in position using a coupling system made of material being compatible to the skin.

The EP 1 448 014 finally describes an earpiece for a hearing aid, the earpiece being adapted for insertion into an ear canal of the user and having at least one resilient fiber that is connected to the earpiece for abutting a lower part of the concha when the earpiece has been inserted in the ear canal, thereby providing retention of the earpiece in the canal of the user.

Despite the fact that appealing design of hearings aids helps to reduce the stigma of wearing hearing aids, it is still important to offer hearing aid products that are characterized by a low visibility. ITEs and ITCs are still clearly visible. CICs are nearly invisible, but have other disadvantages such as e.g. the reduced wearing comfort. Wearing comfort is often reduced with hearing aids that have a hard shell seated in the soft and dynamic cartilaginous region of the ear canal.

Furthermore, occlusion of the ear canal affects severely the listening comfort of the hearing aid wearer. This is particularly true for users with mild or moderate hearing losses and/of for high frequency hearing losses. These users would normally have still sufficient to good hearing capabilities in the low frequencies. Occlusion prevents the natural perception of low frequency sounds and in addition the occlusion effect and the resulting strong perception of low frequencies of the own voice is disturbing.

Currently used ITE, ITC and CIC devices have all problems with regard to both comfort aspects, they have usually hard shells and mostly they occlude the ear canal.

Feedback is a major problem of many ITE, ITC and CIC hearing devices, since there is a close distance between the receiver and the microphone. To reduce the risk of feedback, the receiver must be sealed acoustically from the microphone. The degree of sealing depends on the required gain. At low gain larger vents can be used allowing for a more open fitting. BTE (behind-the-ear) hearing aids in that regard have the advantage to place the microphone inlet as far as possible from the receiver outlet at a given vent size.

All the above mentioned information and facts conclude as a consequence to one object of the present invention, which is to propose a universal hearing aid convenient for a larger number of users without the above described disadvantages and problems. A further object is to propose a hearing aid guaranteeing an agreeable and snug wearing comfort and which can be easily adapted to individual anatomy of an ear canal of a user person.

Most of the previously mentioned existing devices suffer from the disadvantage, that the shell of the hearing aid has two functions: to hold the instrument in place—either inside the ear canal or/and in the concha—and to provide sufficient sealing from the sound outlet to the microphone to prevent acoustic feedback.

Accordingly the present invention proposes a hearing aid according to the wording of claim 1.

The hearing instrument as e.g. a hearing aid as proposed according to the present invention is an in-the-ear hearing instrument comprising a deformable holding element outside the ear canal and a sealing element comprising venting elements.

The sealing element is preferably an exchangeable resilient eartip, which by means of the mentioned venting elements, such as holes, channels, openings, etc. defines the amount of acoustic leakage inside the ear canal.

Thus, by separating these two main functions of the hearing instrument shell by constructive means of two mechanical elements—the holding member and the sealing member—many of the problems associated with 'instant fit hearing aids' can be solved.

The hearing Instrument as proposed according to the present invention is provided to be located primarily in and at the entrance of the ear canal and partially outside the canal within the auricle of the ear and hence is hardly visible from the front. The hearing instrument such as an aid comprises an elongated, at least partially resilient portion provided to be placed at least partially within the auricle of the ear such as e.g. the concha of the ear with the function of holding the hearing aid firmly within the ear. Further, the hearing aid comprises a housing portion provided to be at least partially inserted in the ear canal, dimensioned such that it does not fill out the canal but does at most only partially abut at the inner wall of the ear canal to prevent occlusion to ensure at least still sufficient hearing capability to users e.g. with mild or moderate hearing losses. Further, at the housing portion directed towards the inner ear a resilient shield, umbrella- or mushroom-like eartip member is located dimensioned such that e.g. the outer outline of the member abuts at least partially at the inner wall of the ear canal and therefore keeping the hearing aid firmly within the ear canal. In other words the hearing instrument as e.g. the aid as proposed by the present invention is kept firmly in place or held by the elongated resilient portion within the auricle such as e.g. at the concha of the ear, whereas the member inside the ear canal only provides the necessary sealing with a defined leakage for venting purposes by means of the mentioned venting elements.

According to one embodiment at least one microphone is located within or at the elongated resilient portion, which means it's located in the auricle, preferentially at a position which minimizes the risk of feedback and disturbance of wind noise and which maximizes the natural perception of sound (directionality, frequency response to the acoustic effects of the pinna) and the use of telephones. The at least one microphone could also be arranged at the housing portion projecting out of the ear canal and/or at the intersection to the elongated resilient portion. Furthermore, according to an embodiment of the present invention a receiver unit is located e.g. in or at the housing portion, the receiver and the at least one microphone are being acoustically sealed from each other.

The resilient shield, umbrella- or mushroom-like eartip member is either designed porous and/or is provided in its or near its periphery portion with at least one passage for acoustic penetration between the outside and the inner ear. Furthermore, the resilient eartip member is replaceably mounted on the housing portion.

Again according to a further embodiment a signal processing unit is located in or at the resilient portion e.g. at the concha as well as a battery can be located in or at the resilient portion.

According to a further embodiment it is possible that the resilient elongated portion is preferably preshaped to be easily fitted into the concha of an individual user. Furthermore, within the resilient member an antenna may be integrated.

For the elongated resilient portion as well as for the eartip member which means the shield, umbrella- or mushroom-like member an elastomeric material can be used such as a silicone material or an elastomeric thermoplastic material with the appropriate mechanical properties.

Further possible embodiments of a hearing aid according to the present invention are characterized in dependent claims.

Figure 2:
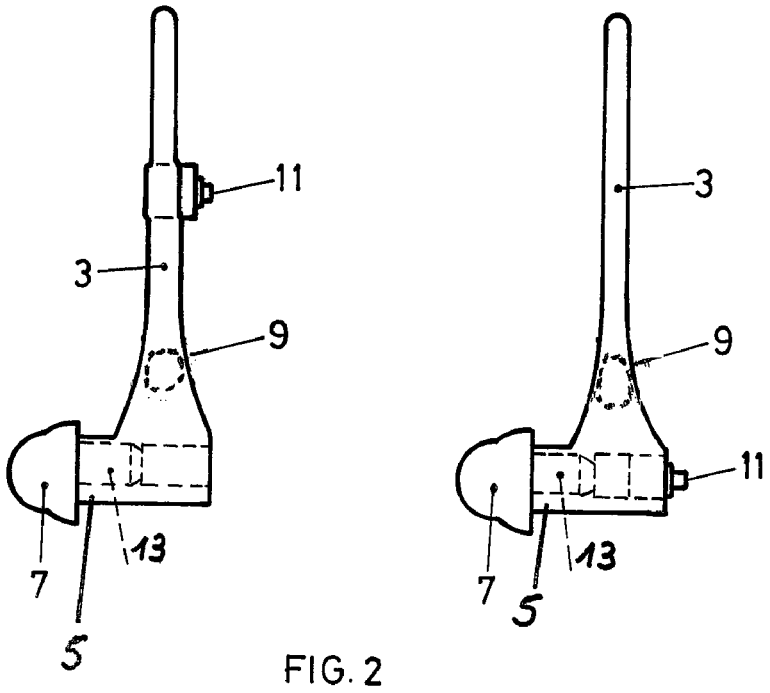
Figure 3A:
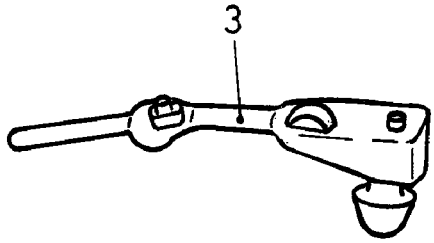
Figure 3B:
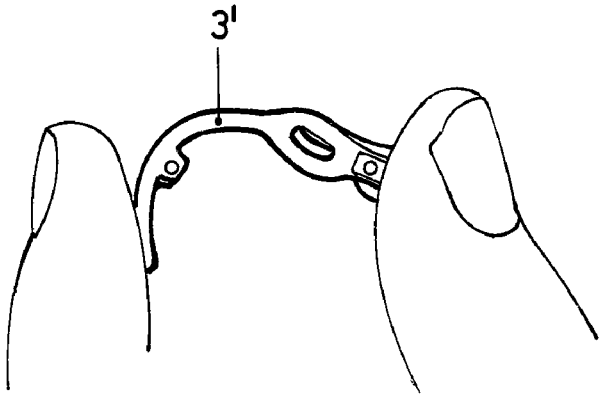
Figure 4:
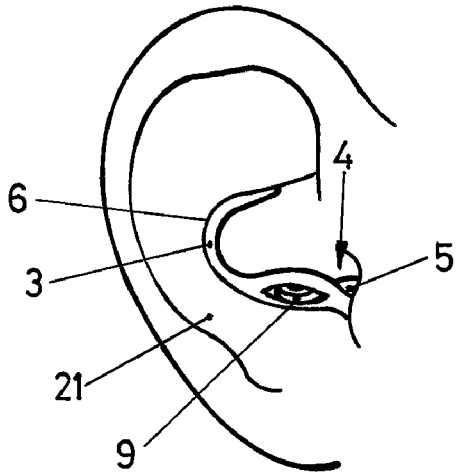

The invention shall be described in more details with reference to the attached figures, in which FIG. 1 shows schematically and in perspective view a hearing device according to the present invention;

FIG. 2 shows possible positions of a microphone within the hearing device according to the present invention;

FIGS. 3*a* and *b* show the resilient characteristic of the resilient portion of the hearing device according to the present invention, and FIG. 4 shows the arrangement of an inventive hearing device within the ear shell of a user person.

Figure 5:
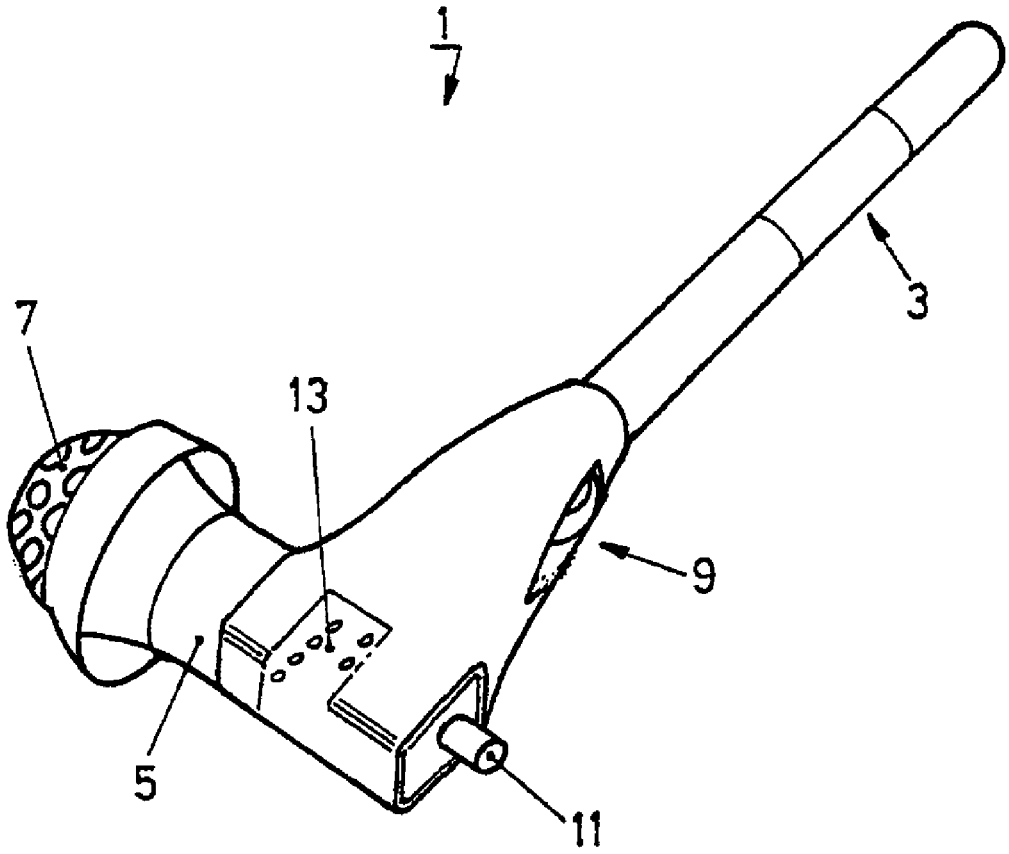

FIG. 5 shows that the resilient eartip member of the hearing device according to the present invention is formed porous.

FIG. 1 shows in perspective view a possible embodiment of a hearing device 1 according to the present invention. The hearing device 1 basically comprises two portions, one longitudinally elongated at least partially resilient portion 3 provided for being arranged within the concha of an ear shell. The second portion can be designated as so-called housing portion 5, which at least partially is provided for being inserted into an ear canal. At the front end of this housing portion 5 directed towards the inner ear a preferably exchangeable resilient eartip member 7 is arranged in the form of a shield, umbrella- or mushroom-like member.

Within the embodiment as shown in FIG. 1 a microphone 11 is arranged at the connecting section between the housing portion 5 and the resilient portion 3. Further, within the resilient portion 3 a battery compartment 9 is arranged and a signal processing unit 13 within the housing portion provided for being projected into the ear canal.

The hearing aid as shown in FIG. 1 is provided for being located primarily at the entrance of the ear canal and in the concha and hence hardly visible from the front. With at least one microphone located in the concha, preferentially at a position which minimizes the risk of feedback and disturbance of wind noise and which maximizes the natural perception of sound (directionality, frequency response to the acoustic effects of the pinna) and the use of telephones. The receiver is located preferentially in the ear canal in a preferentially non-occluding manner, with an insertion loss preferentially of less than about 3 dB (measured with a real ear simulator). The signal processing unit preferably is located in the concha as well as the battery.

The hearing aid as shown in FIG. 1 has a universal shape which optionally can have different sizes. It is resilient over large parts of its length mainly along the extended resilient portion 3. This resilient elongated portion 3 is preferentially preshaped or biased-shaped to be fitted easily into the concha of an individual user. The shapes can be similar to so-called Jansen type non-occluding ear moulds.

The hearing aid as shown in FIG. 1 fits snugly and securely on one side in the concha by adapting itself to the shape of the concha wall while exerting some force to the concha walls. On the other side the housing portion 5 provided for being inserted into the ear canal is designed such that it does at most partially abut to the inner ear wall of the ear canal. In other words the housing portion 5 is firmly held within the ear canal by means of the eartip member, which is made of a resilient material and which with its periphery abuts to the inner wall of the ear canal.

The resilient portion 3 as well as the eartip member 7 are preferably made of an elastomeric material such as an elastomeric thermoplastic material or a silicone material, the elastomeric thermoplastic material having mechanical properties similar to silicone or rubber.

The hearing device as shown in FIG. 1 can be manufactured in the style of a "retention element" which is well known in open fitting applications of BTEs. The receiver, the signal processing unit and the microphone can be assembled in a linear manner, the receiver projecting into the ear canal. The battery compartment is positioned on top of the electronics and is positioned in the concha.

The interconnections between the various elements and especially between the resilient portion 3 and the housing portion 5 can be realized either by using flexible wires or a flexible substrate. These components build a compact electronic module that is then embedded in e.g. a resilient elastomeric matrix.

In FIG. 2 two different possible positions of the microphone are shown. In one embodiment the microphone 11 is placed along the elongated resilient portion 3 to be arranged within the concha of the ear shell. According to another embodiment as also shown in FIG. 2 the microphone 11 is arranged at the interconnecting portion between the resilient portion 3 and the housing portion 5 near the entrance of the ear canal. Of course also the arrangement of two or more microphones is possible.

FIGS. 3*a* and *b* show the resilient housing retention of the resilient portion 3 or 3' respectively. The electronic components are moulded into a resilient matrix which allows large deformations of the instrument in order to fit comfortably in a larger number of ears.

FIG. 4 finally shows the view of the hearing device in an ear auricle 21 from the side. The hearing device is almost invisible, and the only part which can be totally recognized is the battery compartment 9 and part of the housing 5 extending into the ear canal 4. The resilient holding element 3 is arranged within the concha 6 of the auricle 21.

The embodiment of an inventive hearing instrument, as an example of a hearing aid as shown with reference to FIGS. 1 to 4 represents only one example for the better understanding of the present invention. It can be modified or completed by adding further elements in any manner according to usual conventions in hearing aid systems. As a consequence one or more microphones can be arranged at various locations, which are appropriate for receiving audio signals from the outside area. Furthermore, the arrangement of the signal processing unit can be at any location between the resilient elongated member and the housing portion projecting into the ear canal. Preferably between a loudspeaker and the microphone an acoustic sealing is arranged. In addition, the resilient, elongated member opens up the possibility to integrate a large and therefore very sensitive antenna for binaural and remote communication.

Again, the choice of the resilient materials is not mainly part of the present invention, as any suitable elastic material can be used which is biocompatible and which shows high resistance to sweat and cerumen. Of course it is preferred, if the choice of the elastomeric material is such that the moulding process is cheap, fast and reliable. Depending on the intended use no repairs might be foreseen with the exception that damaged instruments can be replaced with new ones and usable components might be salvaged. Therefore, it is preferred if the elastomeric matrix material is easily removable from the components.

Finally it has to be pointed out that the term hearing instrument is not at all limited to a hearing aid, but that all kinds of devices such as hearing protection devices, earphone devices, etc. are included.

The invention claimed is:

1. A hearing instrument to be worn in the ear comprising:

an elongated, at least partially resilient portion (3) to be placed outside the ear canal, housing portion (5) dimensioned such that it is partially inserted into the ear canal and does not fill out the canal and a resilient eartip member (7) located at a housing-like portion in direction to the inner ear, which is designed such that it abuts at least partially at the inner wall of the ear canal.

2. Hearing instrument according to claim 1, characterized in that the eartip member comprises an inner opening enabling output from the hearing instrument into the ear canal.

3. Hearing instrument according to claim 2, wherein the eartip member comprises a central opening enabling output from the hearing instrument into the ear canal.

4. Hearing instrument according to claim 1, characterized in that at least one microphone (11) is located in or at the resilient portion (3) and a receiver is located in or at the housing portion, the receiver and the at least one microphone are being acoustically sealed from each other.

5. Hearing instrument according to claim 1, characterized in that the resilient eartip member being formed porous and/or being provided in its or near its periphery portion with at least one passage for acoustic penetration between the outside and the inner ear area.

6. Hearing instrument according to claim 1, characterized in that a signal processing unit and a battery (9) are being arranged within the resilient portion (3).

7. Hearing instrument according to claim 1, characterized in that an antenna is integrated within the resilient portion (3).

8. Hearing instrument according to claim 1, characterized in that the resilient eartip member (7) is replaceably mounted at or on the housing portion (5).

9. Hearing instrument according to claim 1, characterized in that the elongated resilient portion is preshaped or biased-shaped such that it fits within the concha of a user person.

10. Hearing instrument according to claim 1, characterized in that the elongated resilient portion and the housing portion are arranged in a more or less perpendicular angle and the two portions are connected releasably and/or are connected in a flexible manner in the sense of a hinge.

11. Hearing instrument according to claim 1, characterized in that the at least partially resilient portion and/or the resilient eartip member are consisting of a thermoplastic material with silicone-like or rubber-like properties or the at least partially resilient portion and/or the resilient eartip member are consisting of a silicone material.

12. Hearing instrument according to claim 1, characterized in that the hearing instrument is a hearing aid.

13. Hearing instrument according to claim 1, wherein the housing portion is dimensioned such that it partially abuts the inner wall of the ear canal.

14. Hearing instrument according to claim 1, characterized in that the resilient portion (3) is to be placed at least partially within an auricle (21).

* * * * *